United States Patent [19]

White et al.

[11] Patent Number: 4,531,529

[45] Date of Patent: Jul. 30, 1985

[54] PROCESS FOR INCREASING FILLING CAPACITY OF TOBACCO

[75] Inventors: Jackie L. White, Pfafftown; Lucas J. Conrad, Winston-Salem, both of N.C.

[73] Assignee: R. J. Reynolds Tobacco Company, Winston-Salem, N.C.

[21] Appl. No.: 432,476

[22] Filed: Oct. 4, 1982

[51] Int. Cl.[3] ..... A24B 3/18

[52] U.S. Cl. ..... 131/291; 131/901; 131/902

[58] Field of Search ..... 131/291, 901–903

[56] References Cited

U.S. PATENT DOCUMENTS

| | | | |
|---|---|---|---|
| 3,683,937 | 8/1972 | Fredrickson et al. | 131/901 |
| 4,235,250 | 11/1980 | Utsch | 131/900 |
| 4,289,148 | 9/1981 | Ziehn | 131/291 |

FOREIGN PATENT DOCUMENTS

| | | | |
|---|---|---|---|
| 675292 | 7/1952 | United Kingdom | 131/291 |

*Primary Examiner*—V. Millin
*Assistant Examiner*—Gregory Beaucage
*Attorney, Agent, or Firm*—Manford R. Haxton

[57] ABSTRACT

An improved process for increasing the filling capacity of tobacco is provided in which tobacco is contacted with vapors of an expansion agent such as, for example, a low-boiling highly volatile hydrocarbon and/or halocarbon, at elevated temperature and pressure conditions, then releasing the pressure to about atmospheric pressure in a relatively short time period, such as from one second to ten minutes, so that the tobacco is expanded so as to increase its filling capacity in the absence of a subsequent heating step.

30 Claims, No Drawings

PROCESS FOR INCREASING FILLING CAPACITY OF TOBACCO

BACKGROUND OF THE INVENTION

This invention relates to a process for expanding tobacco to increase its filling capacity, i.e., to reduce its bulk density. The process is especially suitable for treating cigarette cut filler.

During curing, the tobacco leaf loses moisture and shrinks and subsequent storage and treatment, such as cutting, contribute to this shrunken or collapsed condition of the entire leaf, particularly the thin lamina portion which is used for cut filler.

Prior to about 1970, several processes have been suggested or proposed for increasing the filling capacity of tobacco. Insofar as we are aware, none of these proposals were sufficiently practical to be put into commercial production and use. Many did not achieve enough expansion or increase in filling capacity to be economically practical; others created too many fines or otherwise damaged the fragile lamina, while others were applicable only to the easily expanded stem portion of the tobacco leaf and were not applicable to lamina, the principal ingredient of cut filler for cigarettes. Still other suggestions, such as freeze drying, required elaborate and expensive processing equipment and very substantial operating costs.

For example, U.S. Pat. No. 1,789,435 to W. J. Hawkins describes a method and apparatus for increasing the volume of cured tobacco which has undergone shrinkage during curing. In this process, cured and conditioned tobacco is contacted with a gas, which may be air, carbon dioxide or steam, under about 1.4 $Kg/cm^2$ pressure and then the pressure is suddenly released to expand the tobacco constituents toward their original volume. It is stated in this patent that the volume of tobacco may, by that process, be increased by about 5–15%.

A series of patents to Roger Z. de la Burde, U.S. Pat. Nos., 3,409,022; 3,409,023; 3,409,027; and 3,409,028, relate to various processes for enhancing the utility of tobacco stems for use in smoking products by subjecting the stems to expansion operations utilizing various types of heat treatment or microwave energy. Processes for expanding tobacco stems are not particularly relevant, however, because stems are so easily puffed.

U.S. Pat. No. 3,710,802 to William H. Johnson and British Specification No. 1,293,735 to American Brands, Inc., relate to freeze-drying methods for expanding tobacco.

None of these processes have proved to be practical for expanding cut filler.

In 1970, Fredrickson U.S. Pat. No. 3,524,451 (reissued as Re. 30,693 in 1981) and Moser-Stewart U.S. Pat. No. 3,524,452 were granted. These patents describe processes wherein tobacco is contacted with a volatile impregnant and then heated by rapidly passing a stream of hot gas in contact therewith to volatilize the impregnant and expand the tobacco. These flash-expansion processes proved to be the first commercially practical processes for increasing the filling capacity of tobacco, particularly cut filler, and have now been widely accepted and put into extensive commercial use throughout the world.

A variation of these processes is described in the subsequently issued Fredrickson-Hickman U.S. Pat. No. 3,683,937 which teaches increasing the filling capacity of tobacco by contacting it with vapors of a volatile impregnant while maintaining the temperature of the tobacco above the boiling point of the impregnant at the prevailing pressure so that the tobacco remains free of any liquid or solid form of the impregnant, and thereafter rapidly reducing the pressure or rapidly increasing the temperature to provide vapor releasing conditions and expansion of the tobacco.

Armstrong U.S. Pat. No. 3,771,533 involves a treatment of tobacco with carbon dioxide and ammonia gases to form ammonium carbonate in situ. The ammonium carbonate is thereafter decomposed by heat to release the gases within the tobacco cells to cause expansion of the tobacco.

More recently, Utsch U.S. Pat. Nos. 4,235,250, Burde, et al., 4,258,729, and Sykes, et al., 4,336,814 disclose the use of a particular impregnant, carbon dioxide, as the expansion agent in processes wherein the tobacco is contacted with carbon dioxide gas or liquid to impregnate the tobacco, and thereafter the carbon dioxide-impregnated tobacco is subjected to rapid heating conditions to volatilize the carbon dioxide and thereby expand the tobacco.

Insofar as we are aware, all of the processes for increasing filling capacity of tobacco which have been used commercially require a heating step to volatilize the impregnating material which is costly in energy expenditure and equipment needed.

The primary object of this invention is to provide a process for increasing the filling capacity of tobacco wherein no heating step is needed to volatilize the impregnating material for expanding the tobacco cellular structure.

SUMMARY OF THE INVENTION

This invention provides an improved process for increasing the filling capacity of tobacco which comprises contacting tobacco with vapors of an expansion agent at elevated temperature and pressure conditions, then releasing the pressure to about atmospheric pressure in a relatively short time period so that the tobacco is expanded so as to increase its filling capacity in the absence of a subsequent seperate heating step.

The process of this invention can be applied to cured tobacco in the form of leaf (including stems and veins), strips (leaf with the stems removed), or cigarette cut filler (strips cut or shredded for cigarette making). Tobacco in the form of cut filler is preferred because the process is more effective with the smaller particle size and also some of the increase in filling capacity may be lost if expanded tobacco in the form of leaf or strip were subsequently run through a cutter or shredder.

The tobacco to be treated should be in a pliable condition to minimize breakage or shattering during handling and processing. The traditional way of making tobacco pliable is to adjust the water content to within the range of about 8 to 30 percent, preferably about 10 to 16 percent and this water moisture content is quite satisfactory for tobacco which is treated by the process of the present invention. Little water is lost from the tobacco during processing according to the present invention, the moisture content usually being reduced only about 2–4%, therefore starting with a moisture content of about 13 to 16% will result in expanded tobacco of suitable moisture for cigarette making without the need for further moisture adjustment.

Expansion agents which may be used in accordance with this invention are those inert agents which impregnate the tobacco, i.e., which thoroughly permeate the cellular structure of the tobacco, and cause expansion of its cellular structure when pressure is reduced from 36 $Kg/cm^2$ and higher without formation of the solid phase of the agent and without a subsequent heating step. Preferred expansion agents are low-boiling highly volatile compounds which have a critical temperature in the range of 30° to 155° C., preferably 32° to 120° C. The term inert as used herein refers to those agents which do not chemically react with any tobacco component to an appreciable degree. The preferred expansion agents include the light hydrocarbons ethane, propane, propylene, n-butane, isobutane, and the halogenated hydrocarbons (halocarbons) Refrigerant 12 (dichlorodifluoromethane) and Refrigerant 22 (monochlorodifluoromethane). Preferred expansion agents have an atmospheric pressure boiling point in the range of about −90° to about 2° C. Mixtures of expansion agents may be used satisfactorily. Critical values of temperature and pressure for mixtures may be estimated with suitable accuracy using the methods described in "Chemical Engineers' Handbook," Fifth Edition, edited by Robert H. Perry and Cecil H. Chilton and published by McGraw-Hill Publishing Company, pages 3–227 et seq.

The process of the present invention is carried out by placing tobacco having a water moisture content of from about 8 to about 30 wt.% preferably about 10 to about 20% into a suitable pressure vessel and introducing an expansion agent in the vapor state into contact with the tobacco in the vessel to impregnate the tobacco with expansion agent. It is desirable to remove most of the air from the tobacco-containing vessel prior to introduction of the expansion agent. This may be done by vacuum or by purging with an inert gas such as nitrogen. The expansion agent vapor is preferably introduced to the vessel at supercritical temperature, i.e., at a temperature above the critical temperature of the expansion agent, so that little or no liquid expansion agent forms in the vessel as the pressure is increased. The use of hot vapor also serves to warm the tobacco. It is preferable to maintain the temperature of the tobacco above the vapor-liquid equilibrium temperature of the expansion agent during pressurization of the vessel, although some condensation of expansion agent during this time is not harmful. Introduction of expansion agent vapor at a temperature of about 14° to 42° C. above the critical temperature of the expansion agent will, under most circumstances, prevent excessive expansion agent condensation during pressurization of the tobacco-containing vessel. The temperature and pressure conditions required to prevent formation of an excessive amount of condensed liquid expansion agent during pressurization may be ascertained easily by use of temperature pressure-enthalpy diagrams. In order to maximize the degree of tobacco expansion attained, it is preferred that the temperature of the tobacco while under expansion agent pressure not be higher than about 42° C. above the critical temperature of the expansion agent used.

In the process of this invention gaseous expansion agent is contacted with the tobacco at a pressure of at least 36 $Kg/cm^2$, preferably at supercritical pressure (i.e., pressure above the critical pressure of the expansion agent), more preferably above 57 $Kg/cm^2$ and still more preferably above 71 $Kg/cm^2$. There is no known upper limit to the pressure which can be used in this process. Tobacco can be expanded by this process to a satisfactory extent without excessive fracturing by using pressures below 142 $Kg/cm^2$, so higher pressures usually are not needed.

Because of the time required to increase expansion agent pressure to 36 $Kg/cm^2$ and above, typically about one to 10 minutes, and because the expansion agent is introduced as a gas, little or no additional holding time under pressure is needed in order to achieve effective impregnation of the tobacco by the expansion agent. When using lower pressures, e.g., 36 to 57 $Kg/cm^2$, somewhat greater expansion of the tobacco can be achieved by maintaining the pressure for a brief period of about one to 10 minutes before initiating depressurization. Depressurization is carried out at a relatively high rate so that the pressure is reduced to or near atmospheric pressure within a time period of one second to 10 minutes, preferably about 3 to 300 seconds, optimally about 5 to 30 seconds.

Expansion agent gases removed from the tobacco during the depressurization step may be recovered by known means for reuse, if desired. Expansion agent is expelled from the tobacco during depressurization and the tobacco is removed from the pressure vessel after the pressure is reduced to zero gauge pressure. Surprisingly, no heating step is required subsequent to pressurization either to cause expansion of the tobacco or to set or fix the tobacco in expanded condition. Several advantages arise from the absence of a subsequent heating step. Among these is a higher quality expanded tobacco product because volatile constituents have not been driven off by heating. Other advantages include reduced handling of the tobacco with consequent breakage and lower equipment and operating costs.

DETAILED DESCRIPTION OF THE INVENTION

This invention relates broadly to the use of low-boiling highly volatile expansion agents in a process for increasing the filling capacity of tobacco. Increases in filling capacity of 50% and more are achieved without the necessity for a heating step needed by some other processes in order to set or fix the tobacco in expanded condition. The preferred expansion agents are those normally gaseous hydrocarbons and halocarbons having an atmospheric pressure boiling point in the range of from −90° to 2° C. These compounds have a critical temperature in the range of from 30° to 155° C. The boiling points and critical points of preferred expansion agents are listed in the table below:

| Expansion Agent | Boiling Point, °C. | Critical Point | |
|---|---|---|---|
| | | Temp., °C. | Press., $Kg/cm^2$ |
| Ethane | −89 | 32 | 49.9 |
| Propane | −42 | 97 | 43.4 |
| Propylene | −47 | 92 | 47.1 |
| Isobutane | −12 | 135 | 37.2 |
| n-Butane | −0.5 | 152 | 38.7 |
| R-12 | −30 | 112 | 42.0 |
| R-22 | −41 | 96 | 50.7 |

Mixtures of these compounds may also be used as expansion agents. For ease of operation, however, it is preferred to use a relatively pure expansion agent containing at least about 90 to 95% of one compound.

To carry out the tobacco expansion process of the present invention, tobacco having a moisture content in the range of about 8 to 30 wt.% is confined within a pressure vessel provided with one or more conduits for introducing and withdrawing gases. Preferably, most of the air is removed from the tobacco-containing vessel prior to introduction of expansion agent to increase safety when combustible expansion agents are used and to reduce dilution of the expansion agent gases to be introduced into the vessel. This can be done by purging the vessel with an inert gas, such as nitrogen or expansion agent, or by the use of vacuum. It is preferred to evacuate air from the vessel, suitably to a pressure of about 125 mm. of mercury absolute. Expansion agent is then introduced into contact with the tobacco in the vessel, the temperature of the expansion agent as it is introduced being in the range of between the critical temperature of the expansion agent and about 42° C. above the critical temperature. Pressurization of the tobacco within the vessel is continued until the expansion agent pressure is at least about 36 Kg/cm$^2$, preferably above about 57 Kg/cm$^2$, most desirably above about 71 Kg/cm$^2$. The expansion agent pressure should be above about 4.5 Kg/cm$^2$ below the critical pressure of the expansion agent. Impregnation of the tobacco with the expansion agent is normally satisfactorily complete by the time the desired pressure is reached, however, when using lower pressures in the range of 36 to 57 Kg/cm$^2$, it may be advantageous to maintain the pressure for about one to ten minutes prior to initiation of depressurization. Pressure within the vessel is then reduced to about atmospheric pressure within a period of one second to ten minutes, preferably within a time period of 3 to 300 seconds, most desirably within about 5 to 30 seconds, by venting expansion agent gases from the vessel through a throttle valve. The vessel is then opened and expanded tobacco is recovered from it. No additional heating step is needed to set or fix the tobacco in its expanded condition. The expanded tobacco can easily be adjusted to ambient temperature by conventional means. The expansion agent gases vented from the vessel during the depressurization step may be recovered by conventional means, if desired.

While the phenomenon by which expansion occurs is not fully understood, it is probable that most effective expansion of tobacco is achieved when at least a portion of the expansion agent is transformed to the liquid or condensed phase in the tobacco during depressurization and subsequently vaporizes as the pressure is further reduced. It is not known at what point during the process expansion of the tobacco occurs, but it is believed to occur during the depressurization. When the pressure vessel is opened for recovery of tobacco after depressurization is complete, surprisingly it is found in expanded condition without damage to the cellular structure, its filling capacity having been increased by 50% or more. Filling capacity increases of over 100% and even up to 150% and more have been achieved by use of this process.

Tobacco moisture content as used herein is expressed as the percent reduction in tobacco weight upon heating in a convection oven for 15 minutes at 100° C. The filling capacity of tobacco as used herein was determined using a measuring device essentially composed of a 100 milliliter graduated cylinder having an internal diameter of about 25 millimeters and a piston having a diameter of about 24 millimeters and weighing about 802.5 grams slideably positioned in the cylinder. A three-gram sample of tobacco was placed in the cylinder and the piston was positioned on it. The gravitational force exerted by the piston corresponded to a pressure of about 0.16 Kg/cm$^2$ (2.3 psi). The filling value, or filling capacity, of the sample was the volume to which the three-gram sample of tobacco in the cylinder was compressed after the weight of the piston had acted on it for a period of three minutes. This pressure corresponds closely to the pressure normally applied by the wrapping paper to tobacco in cigarettes. The moisture content of tobacco affects the filling values determined by this method; therefore, comparative filling capacities of tobacco, both before and after expansion, were made with tobacco having essentially the same moisture contents. The percent increase in filling capacity, or percent expansion, was computed by subtracting the filling capacity of the unexpanded control sample from the filling capacity of the expanded sample, dividing this difference by the filling capacity of the control sample and multiplying this quotient by 100.

For a more complete understanding of this invention, reference will now be made to specific examples of procedures for carrying it into effect.

EXAMPLE 1

Tobacco expansion experiments were conducted using apparatus comprising a pressure vessel having a volume of 4.5 liters capable of containing pressures above 100 Kg/cm$^2$. The vessel could be easily opened and closed for introduction and removal of tobacco. A thermocouple was installed inside the vessel to measure the temperature of vessel contents and a pressure gauge indicated the pressure in the vessel. Expansion agent was introduced into the vessel through a heater and a tubing coil immersed in a liquid bath maintained at a temperature of 120°–130° C. Expansion agent vapor was vented from the vessel through a tubing line provided with a throttle valve.

Experiments using various expansion agents were carried out by placing about 450 grams of a cigarette cut filler blend of burley and flue-cured tobaccos into the vessel and closing it. Vacuum was then used to reduce the pressure in the vessel to about 125–130 mm. Hg absolute. Expansion agent was then introduced to the vessel through the heater and tubing coil until the desired pressure within the vessel was reached. The length of time from first introduction of expansion agent until the desired pressure was attained is denoted herein as pressurization time. The temperature and pressure within the vessel were read from indicators when the maximum pressure was reached and are denoted herein as chamber temperature and chamber pressure. The period of time that the vessel was at chamber pressure prior to beginning of venting expansion agent from the vessel is denoted herein as impregnation time, although it is realized that impregnation of the tobacco with expansion agent also occurs during pressurization. At the end of the impregnation time, if any, the throttle valve was opened and expansion agent was vented from the vessel until the pressure in the vessel decreased to substantially atmospheric pressure. The time during which venting occurred is denoted herein as depressurization time.

When venting of the vessel was complete the vessel was opened and the tobacco, then in expanded condition, was removed. Generally speaking, the temperature of the tobacco at the time depressurization was completed was in the range of 15° to 65° C. lower than the chamber temperature reached during an experimental test. The expanded tobacco was allowed to reach ambient temperature and then the moisture content and filling capacity were determined.

In the following Table I are listed typical experiments with conditions used and filling capacity increases obtained. The tobacco moisture content listed in the table is the percent moisture in the unexpanded sample as it was placed into the pressure vessel, expressed in weight percent. Depressurization time for each experiment was 5 to 20 seconds.

| Expan. Agent Used | Tob. Moist. wt. % | Chamb. Temp. °C. | Chamb. Press., Kg/cm² | Press. Time, Min-Sec | Im-preg. Time, Min-Sec | % Ex-pan-sion |
|---|---|---|---|---|---|---|
| Ethane | 15.9 | 60 | 85 | 0-55 | 3-0 | 65 |
| Propylene | 19.5 | 123 | 106 | 1-36 | 4-24 | 93 |
| Propylene | 16.6 | 118 | 106 | 1-34 | 4-24 | 84 |
| R-22 | 16.6 | 129 | 106 | 1-16 | 4-44 | 53 |
| R-22 | 11.4 | 127* | 106 | 1-20 | 6-0 | 50 |
| R-12 | 16.0 | 129 | 96 | 4-36 | 1-30 | 106 |
| R-12 | 14.8 | 126 | 106 | 5-25 | 2-34 | 111 |
| R-12 | 17.3 | 127 | 106 | 5-38 | 2-34 | 133 |
| Propane | 13.6 | 96 | 43 | 1-05 | 6-0 | 65 |
| Propane | 16.5 | 100 | 52 | 3-50 | 6-0 | 91 |
| Propane | 13.6 | 107 | 57 | 4-0 | 3-30 | 95 |
| Propane | 17.3 | 110 | 64 | 1-18 | 0-0 | 90 |
| Propane | 15.8 | 113 | 85 | 1-47 | 0-48 | 101 |
| Propane | 17.8 | 125 | 96 | 2-04 | 1-30 | 123 |
| Propane | 19.5 | 124 | 106 | 2-40 | 2-34 | 137 |
| Propane | 16.4 | 124 | 106 | 2-12 | 2-34 | 159 |

*Estimated

EXAMPLE 2

A sample of cigarette cut filler blend having a moisture content of 13.8% was placed in a small laboratory pressure vessel and pressurized with a mixture of light hydrocarbons having the following composition in weight percent: 0.67% methane, 7.51% ethane, 90.17% propane, 0.1% n-butane, and 1.55% isobutane. The critical temperature and critical pressure for this expansion agent mixture were calculated to be 92° C. and 50 Kg/cm², respectively. The vessel was pressurized to a chamber pressure of 40 Kg/cm² with this mixture at which time the chamber temperature was 85° C. After an impregnation time of six minutes the expansion agent was vented from the vessel in a depressurization time of one minute. The tobacco was removed from the vessel and found to have a filling capacity 109% greater than the unexpanded sample.

While particular embodiments of this invention have been described in the foregoing, it will, of course, be apparent that other modifications may be made without departing from the spirit and scope of this invention.

What is claimed is:

1. A process for increasing the filling capacity of tobacco which comprises contacting tobacco with an inert gaseous expansion agent at a pressure above about 4.5 Kg/cm² below the critical pressure of said expansion agent and at a temperature in the range of from about 20° C. below to about 42° C. above the critical temperature of said expansion agent and subsequently releasing the pressure within a time period of from one second to ten minutes, thereby causing the tobacco to expand.

2. The process of claim 1 wherein said contacting is effected at a temperature in the range of from the critical temperature of said expansion agent to about 42° C. above said critical temperature.

3. The process of claim 1 or 2 wherein said contacting is effected at a pressure above about 57 Kg/cm².

4. The process of claim 1 or 2 wherein said contacting is effected at a pressure above about 57 Kg/cm² and said time period is from 3 to 300 seconds.

5. The process of claim 1 or 2 wherein said contacting is effected at a pressure above about 57 Kg/cm², said time period is from 3 to 300 seconds and said expansion agent is selected from the class consisting of hydrocarbons and halocarbons having an atmospheric pressure boiling point in the range of −90° to 2° C.

6. A process for increasing the filling capacity of tobacco at least 50% which comprises, impregnating the tobacco with vapor of an inert expansion agent at supercritical pressure for said agent and thereafter reducing the pressure so as to cause the expansion agent to expand the cellular structure of the tobacco and to be expelled therefrom without the necessity of subjecting the tobacco to additional heat.

7. A process for increasing the filling capacity of cut filler tobacco for cigarettes which comprises impregnating the tobacco with vapor of a low-boiling highly volatile inert expansion agent at supercritical conditions of pressure and temperature for said agent and thereafter reducing the pressure so as to cause the expansion agent to be expelled therefrom to expand the cellular structure of the tobacco by at least 50% and without subjecting the tobacco to additional heat.

8. A process for increasing the filling capacity of cigarette cut filler tobacco by expanding its cellular structure which comprises placing the tobacco in a pressure vessel, introducing a low-boiling highly volatile inert gaseous expansion agent having a critical temperature between 32° C. and 120° C. into the vessel in contact with the tobacco and increasing the pressure to above the critical pressure of the expansion agent to thoroughly permeate the cellular structure of the tobacco with the expansion agent in a highly condensed state, thereafter reducing the pressure to cause the expansion agent to change from its highly condensed state to an expanded vapor state, thereby expanding the cellular structure by at least 50% as the expansion agent is expelled therefrom.

9. A process for increasing the filling capacity of tobacco which comprises contacting tobacco with an inert gaseous expansion agent selected from the class consisting of hydrocarbons and halocarbons, at a pressure of at least 36 Kg/cm² and at a temperature in the range of from about 20° C. below to about 42° C. above the critical temperature of said expansion agent, and subsequently expelling said expansion agent from the tobacco by releasing the pressure within a time period of from one second to ten minutes, thereby expanding the cellular structure of the tobacco.

10. The process of claim 9 wherein said time period is 3 to 300 seconds.

11. The process of claim 9 wherein said time period is 5 to 20 seconds.

12. The process of claim 9 wherein said contacting is effected at a pressure above about 70 Kg/cm².

13. A process for increasing the filling capacity of tobacco by 50% or more which comprises contacting tobacco having a moisture content in the range of 10 to 30 wt.% with an inert normally-gaseous expansion agent selected from the class consisting of hydrocarbons and halocarbons having a critical temperature in the range of from 30° to 155° C., said contacting being effected at a pressure above about 36 Kg/cm² and at a temperature in the range of from 20° C. below to 42° C. above the critical temperature of said expansion agent to produce tobacco impregnated with said expansion agent, releasing said expansion agent from said impregnated tobacco at a rate such that the pressure is reduced to about atmospheric pressure within a time period of one second to ten minutes to expand the cellular structure of the tobacco in the absence of a separate heating step.

14. A process for expanding tobacco to increase the filling capacity thereof which comprises contacting tobacco with an inert vaporous expansion agent selected from the group consisting of hydrocarbons and halocarbons having a critical temperature in the range of from 30° to 155° C., said contacting being effected at a temperature equal to or greater than the critical temperature of said expansion agent and at a pressure above about 4.5 Kg/cm$^2$ below the critical pressure of said expansion agent to impregnate the tobacco, reducing the pressure causing at least a portion of said expansion agent to transfer to the liquid phase and condense in the tobacco, continuing to reduce the pressure until the pressure reaches about atmospheric pressure in less than about ten minutres, thereby causing the expansion agent to be vaporized and separated from the tobacco and the tobacco to be expanded.

15. The process of claim 14 wherein said contacting is effected at a pressure of at least about 57 Kg/cm$^2$.

16. A process for increasing the filing capacity of tobacco which comprises contacting tobacco with an inert vaporous expansion agent selected from the group consisting of ethane, propane, propylene, dichlorodifluoromethane, monochlorodifluoromethane, isobutane, n-butane, and mixtures thereof, at a temperature from 20° C. below up to 42° C. above the critical temperature of said expansion agent and at a pressure above about 4.5 Kg/cm$^2$ below the critical pressure of said expansion agent to impregnate the tobacco, and reducing the pressure until the expansion agent pressure on the tobacco reaches substantially atmospheric pressure within a period of one second to about ten minutes, thereby causing the expansion agent to be expelled from the tobacco and the tobacco to expand.

17. A process for increasing the filling capacity of tobacco which comprises confining tobacco within a pressure vessel, introducing an inert gaseous expansion agent selected from the class consisting of hydrocarbons and halogenated hydrocarbons having a critical temperature in the range of from 30° to 155° C. into said vessel into contact with said tobacco in an amount sufficient to raise the pressure within said vessel to above about 70 Kg/cm$^2$ while maintaining said expansion agent substantially in the vapor phase, releasing the gaseous expansion agent from said vessel at a controlled rate to reduce the pressure in said vessel to substantially atmospheric pressure within a time period of from one second to ten minutes, thereby expanding the tobacco without adding heat.

18. The process of claim 17 wherein said time period is from 3 to 300 seconds.

19. The process of claim 17 wherein said expansion agent is selected from the group consisting of ethane, propane, propylene, Refrigerant 12, Refrigerant 22, isobutane, n-butane, and mixtures thereof.

20. The process of claim 19 wherein said time period is from 5 to 20 seconds.

21. Tobacco treated in accordance with the process of claim 17.

22. The process of claim 1, wherein the expansion agent is a material which has a critical temperature within the range of about 32° C. to 120° C.

23. The process of claim 22, wherein the expansion agent is a light hydrocarbon, a halogenated hydrocarbon or a mixture thereof.

24. The process of claim 25, wherein the expansion agent comprises ethane, propane, propylene, n-butane, isobutane, dichlorodifluoromethane or monochlorodifluoromethane or a mixture thereof.

25. The process of claim 24, wherein the expansion is effected without an additional heating step.

26. The process of claim 1, wherein the expansion agent comprises a mixture of materials, and wherein the filling capacity of the tobacco is increased by at least 50%.

27. The process of claim 1, wherein the expansion agent is a material having an atmospheric boiling point of about −90° to about 2° C.

28. The process of claim 1, wherein the pressure at which the tobacco is contacted with the expansion agent is below about 142 Kg/cm$^2$.

29. The process of claim 6, 7, 9, 13, 14 or 16 wherein the expansion agent comprises a hydrocarbon or halogenated hydrocarbon having a critical temperature within the range of 32° C.–120° C.

30. The process of claim 29, wherein the tobacco is contacted with the expansion agent at a pressure above about 4.5 Kg/cm$^2$ below the critical pressure of the expansion agent.

* * * * *

UNITED STATES PATENT AND TRADEMARK OFFICE

CERTIFICATE OF CORRECTION

PATENT NO. : 4,531,529
DATED : July 30, 1985
INVENTOR(S) : Jackie L. White and Lucas J. Conrad It is certified that error appears in the above-identified patent and that said Letters Patent are hereby corrected as shown below:

Column 10, line 25:

"The process of claim 25," should read --The process of claim 22,--

Signed and Sealed this

*Thirty-first* Day of *December 1985*

[SEAL]

*Attest:*

DONALD J. QUIGG

*Attesting Officer*

*Commissioner of Patents and Trademarks*